US006871686B2

(12) United States Patent
Eshpar

(10) Patent No.: US 6,871,686 B2
(45) Date of Patent: Mar. 29, 2005

(54) ARTICULATED STRUCTURE

(76) Inventor: Yonathan Eshpar, Simtat Nes Ziona 4B, Tel Aviv 83324 (IL)

( * ) Notice: Subject to any disclaimer, the term of this patent is extended or adjusted under 35 U.S.C. 154(b) by 0 days.

(21) Appl. No.: 10/362,938

(22) PCT Filed: Aug. 26, 2001

(86) PCT No.: PCT/IL01/00798

§ 371 (c)(1),
(2), (4) Date: Feb. 27, 2003

(87) PCT Pub. No.: WO02/18736

PCT Pub. Date: Mar. 7, 2002

(65) Prior Publication Data

US 2004/0010983 A1 Jan. 22, 2004

(30) Foreign Application Priority Data

Aug. 29, 2000 (IL) ..... 138156

(51) Int. Cl.[7] ..... E06B 3/48
(52) U.S. Cl. ..... 160/231.1; 160/133; 160/238
(58) Field of Search ..... 160/231.1, 133, 160/238, 264, 231.2

(56) References Cited

U.S. PATENT DOCUMENTS

| | | | | | |
|---|---|---|---|---|---|
| 93,789 | A | * | 8/1869 | Worth | 160/231.1 |
| 242,436 | A | * | 6/1881 | Cutler | 160/183 |
| 683,264 | A | * | 9/1901 | Flemister | 108/159.12 |
| 1,015,332 | A | * | 1/1912 | McCloud | 160/231.1 |
| 1,064,216 | A | * | 6/1913 | Hick | 160/231.1 |
| 1,893,659 | A | * | 1/1933 | Stack | 160/133 |
| 2,054,499 | A | * | 9/1936 | Florman | 428/77 |
| 2,324,398 | A | * | 7/1943 | Kahr | 160/113 |
| 3,084,403 | A | * | 4/1963 | Elmendorf | 428/166 |
| 3,717,247 | A | * | 2/1973 | Moore | 206/321 |
| 3,766,691 | A | * | 10/1973 | Ray | 52/71 |
| 4,142,931 | A | * | 3/1979 | Viol et al. | 156/257 |
| 4,234,973 | A | | 11/1980 | Vetter et al. | |
| 5,065,808 | A | | 11/1991 | Hopperdietzel | |
| 5,123,473 | A | * | 6/1992 | Henkenjohann | 160/264 |
| 5,148,850 | A | * | 9/1992 | Urbanick | 160/231.1 |
| 5,549,195 | A | | 8/1996 | Aulagner et al. | |
| 5,884,566 | A | | 3/1999 | Chen | |

FOREIGN PATENT DOCUMENTS

| | | | | |
|---|---|---|---|---|
| EP | 0263628 | | 4/1988 | |
| FR | 9608759 | * | 7/1996 | 160/231.1 X |

OTHER PUBLICATIONS

Machine Design—Jun. 15, 2000 "Guidelines for Bonding Plastics".

* cited by examiner

*Primary Examiner*—Bruce A. Lev
(74) *Attorney, Agent, or Firm*—Mark M. Friedman

(57) ABSTRACT

An articulated collapsible planar structure (10), including a number of parallel rigid beams (12) of substantially trapezoid cross-section rigidly attached in close formation. The structure (10) is rollable into a compact cylindrical package when the thin sheet faces the center of curvature and forms a curved structure when the beams face toward the center of the curvature.

15 Claims, 4 Drawing Sheets

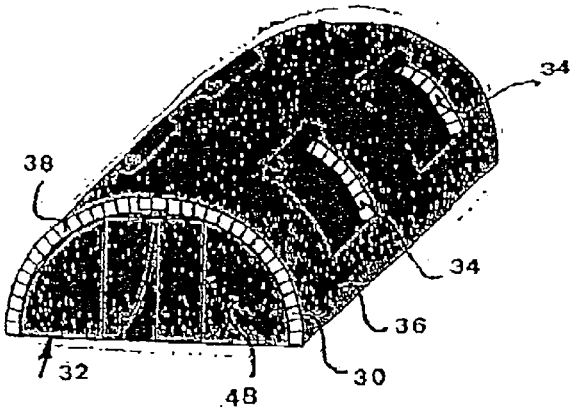
FIG. 4a
FIG. 4b
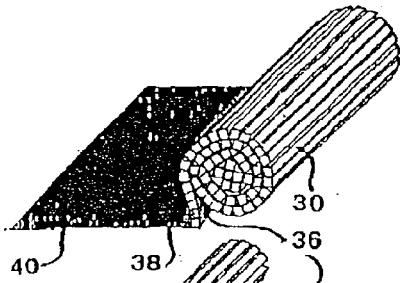
FIG. 4c
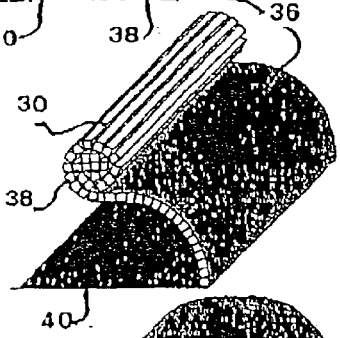
FIG. 4d
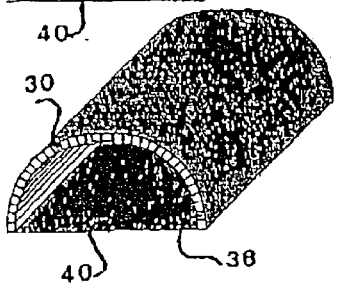
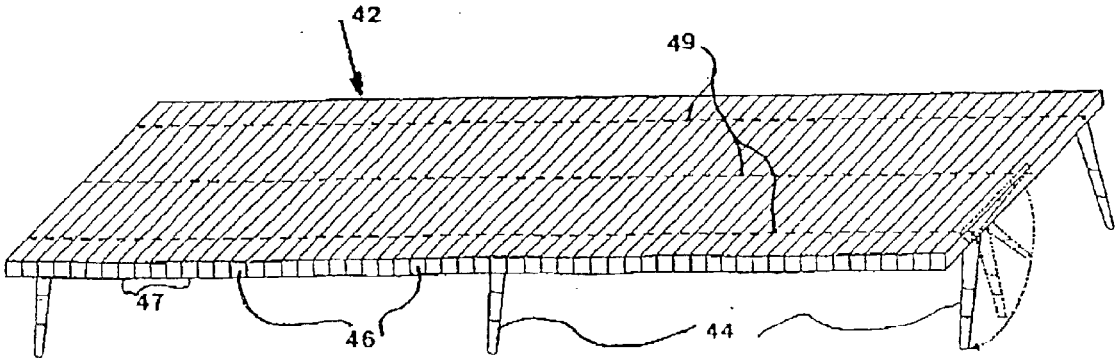
FIG. 5

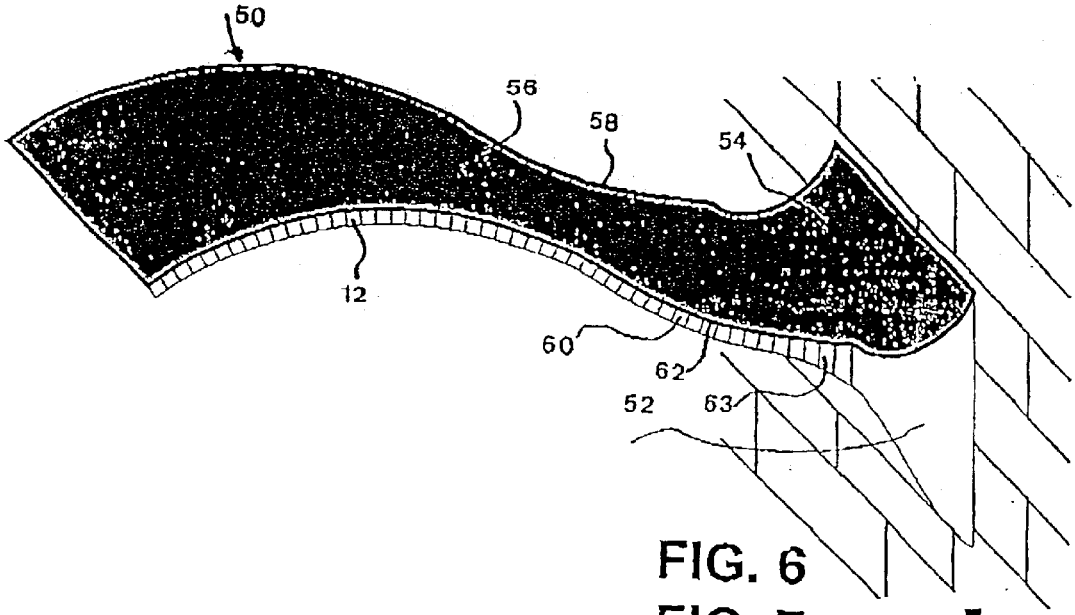
FIG. 6
FIG. 7
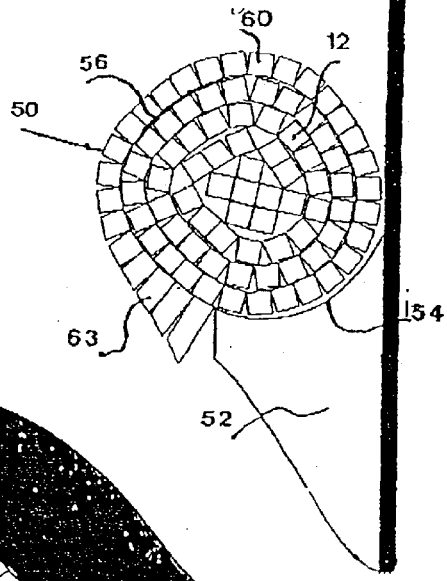
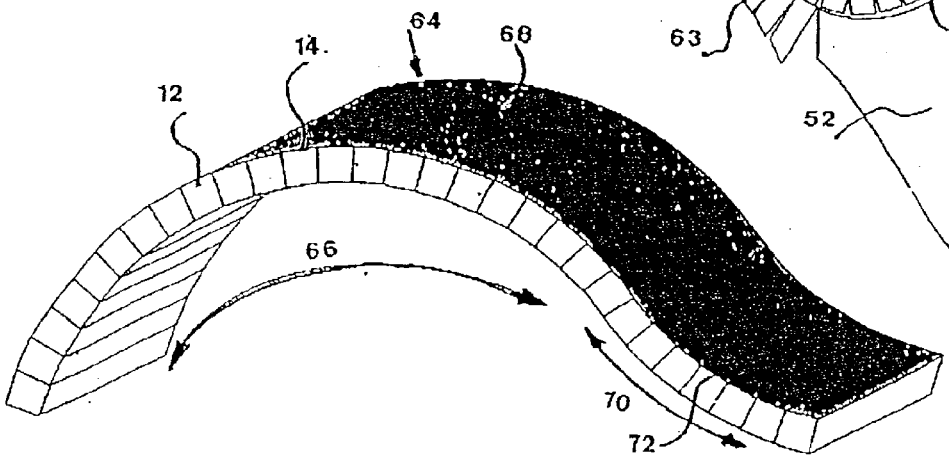
FIG. 8

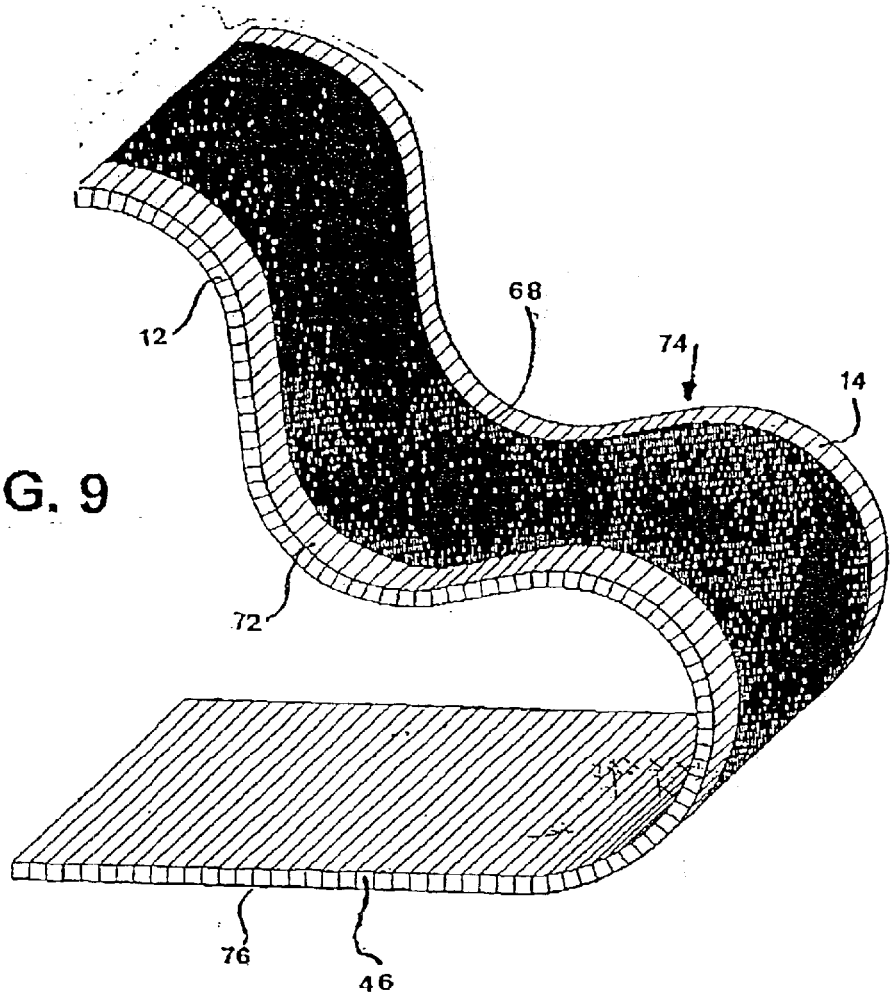
FIG. 9
FIG. 10
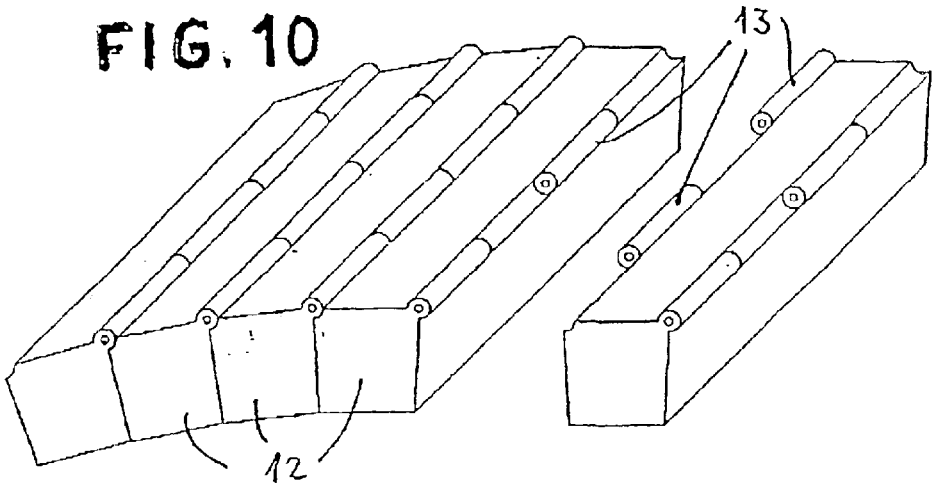

ARTICULATED STRUCTURE

The present invention relates to a foldable structure having wide-ranging applications. More particularly, the invention provides an articulated collapsible structure comprising of multiple beams connected on one face by a flexible sheet or cables, or hinges.

Assemblies of slats, such as are found in window shutters and special-purpose conveyor belts are interconnected by flexible bands or cables enabling the assembly to take up a curved form, such as is necessary for the conveyor belt or window shutter to pass around a drive drum or end roller. The slats are usually thin and are arranged so that the flexible band passes through the center of thickness of the slat. In this type of construction, the belt or shutter assembly can be curbed, within the limits of a certain minimum bend radius, typically in either direction. Other assemblies are designed to be curbed in only one direction, see for example the wood-slat belt described by Aulagner et al. in U.S. Pat. No. 5,549,195. Assemblies of this type can not be, and are not intended to be used as unsupported structures, due primarily to the thin slats, and the flexible strip being positioned in mid-thickness thereof. If an extended length of such a construction is supported as a horizontal cantilever it is usually seen that the construction can not even support its own weight, and collapses either because of stretching of the flexible strip, or compression damage to the edges of the slats, or a combination thereof, or simply because the slats are spaced too far apart to support each other.

It is therefore one of the objects of the present invention to provide a new type of articulated assembly which is usable in structural applications It is a further object of the present invention to provide such an assembly which after use may be dismantled by rolling into a substantially cylindrical form.

The present invention achieves the above objects by providing an articulated collapsible planar structure, comprising a plurality of parallel rigid beams of substantially trapezoidal cross-section rigidly attached in close formation, the structure being rollable into a compact cylindrical package when the thin sheet faces the center of curvature and forming a curved structure when the beams face towards the center of curvature.

The beams could be attached in close formation by one of the two unequal faces to a thin sheet of a tensile strong material.

The beams could also be attached in close formation by hinges provided at one of the faces of the beam.

In a preferred embodiment of the present invention there is provided an articulated collapsible planar structure, being sized to serve as a substantially semi-circular-section building.

In a most preferred embodiment of the present invention there is provided an articulated collapsible planar structure, being sized to serve, in combination with a wall support, as a cantilever awning.

In a further preferred embodiment of the present invention there is provided an articulated collapsible planar structure being sized to serve as a chair.

Yet further embodiments of the invention will be described hereinafter.

It will thus be realized that the novel structure of the present invention is well suited for varied articles being the construction of temporary buildings, often required by the military, by oil exploration companies, for sporting events or furniture and the like.

The preferred form of such building is a semicircular prism, as will be illustrated. After use the main component of the building is rolled up into a bundle for convenient transportation and storage.

The materials from which the structure of the present invention is made will differ according to the application, the length of required service, and whether or not weight restrictions apply, for example where the structure is to be repeatedly air transported.

The three basic requirements in design of the articulated structure of the present invention can be stated briefly as follows:

a) The flexible sheet is stretch resistant. A thin strip or sheet of stainless steel, a steel cable, a fiber-reinforced plastic are examples of suitable materials.

b) The beams are crush resistant. Many solid materials (metals, hard wood, plastics) are acceptable, and where metals or strong plastics are used, and wall thickness is adequate, the shape may be hollow.

c) The beams—particularly the end beams—are firmly attached to the sheet. Depending on the type of material used, attachment may be effected by welding, brazing, adhesives, screws or rivets. Recent advances in the adhesive technology, see for example "MACHINE DESIGN" Jun. 15, 2000, page 69 "Guidelines for Bonding Plastics", make adhesives a particularly attractive option, as there are no externally visible signs of the bond, adhesives are ideal for thin sheets and different materials can be joined together.

It is within the scope of the Invention to use other means such as hinges as will be elaborated.

The radius of curvature obtained when the structure is freely suspended can be adjusted to suit practically any requirement, including a radius of infinity, i.e. a flat surface. For a small radius the trapezoidal section of the beam is angled a little further from the rectangular. Where a small radius is required but an existing profile is to be used due to manufacturing considerations, a small space between the beams achieves the desired object.

Where the radius of the suspended structure is large, that is when the upper face thereof is to be close to flat, the trapezoid used is substantially a square or rectangle and there are no spaces between the beams.

The invention will now be described further with reference to the accompanying drawings, which represent by example preferred embodiments of the invention. Structural details are shown only as far as necessary for a fundamental understanding thereof. The described examples, together with the drawings, will make apparent to those skilled in the art how further forms of the invention may be realized.

FIG. 4*a* is a perspective view of a completed temporary building erected by use of the structure;

FIG. 4*b* is a perspective view of a first step in erecting the building shown in FIG. 4*a;*

FIG. 4*c* is a perspective view of a second step in erecting the building;

FIG. 4*d* is a perspective view of a third stop in erecting the building;

FIG. 5 is a perspective view of a camp bed made of the structure

FIG. 6 is a perspective view of an embodiment arranged as an awning and shown in deployed form;

FIG. 7 is an end view of the embodiment of FIG. 6 shown in rolled up form;

FIG. 8 is a perspective view of an embodiment provided with both convex and concave sections; and FIG. 9 is a perspective view of an embodiment arranged for use as a beach chair.

FIG. 10 is a further embodiment where hinges are used.

Figure 1:
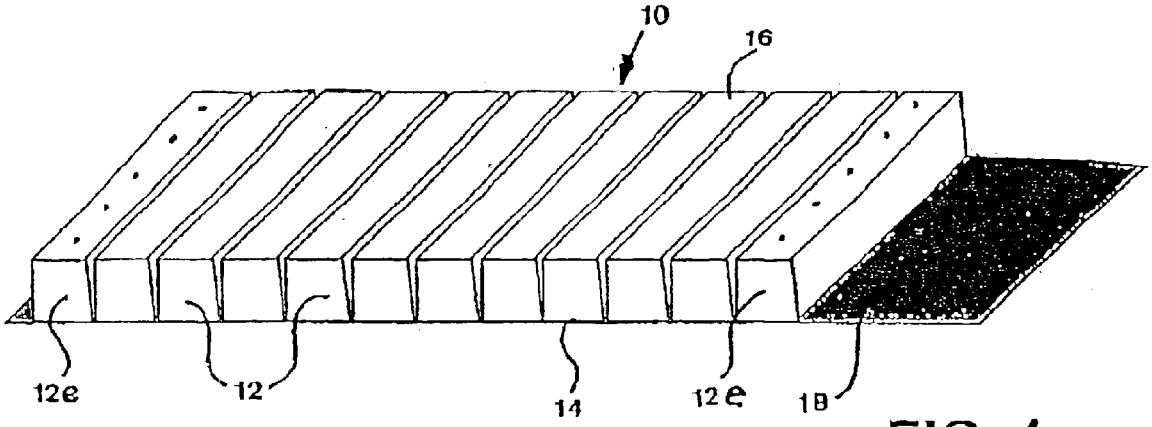
FIG. 1 is a perspective view of a preferred embodiment of the structure according to the invention.

There is seen in FIG. 1 an articulated collapsible planar structure 10. A plurality of parallel rigid beams 12 of substantially trapezoidal cross-section are rigidly attached in close formation by the longer 14 of the two unequal faces 14, 16 to a flexible sheet 18 of a tensile strong material, for example a thin (0.1–0.3 mm) sheet of stainless steel.

Advantageously the beams 12 are rigidly attached to the sheet 18 by means of an adhesive, after appropriate preparation of the surfaces to be bonded. The type of adhesive used (cyanoacrylates, hot-melts, polyurethanes) is dependent on the materials to be bonded, although some adhesives, such as rubber based and epoxies can be used for almost any combination.

Advantageously the end beams 12*e* are attached by rivets 20 in addition to being adhesively bonded to the sheet 18.

Figure 2:
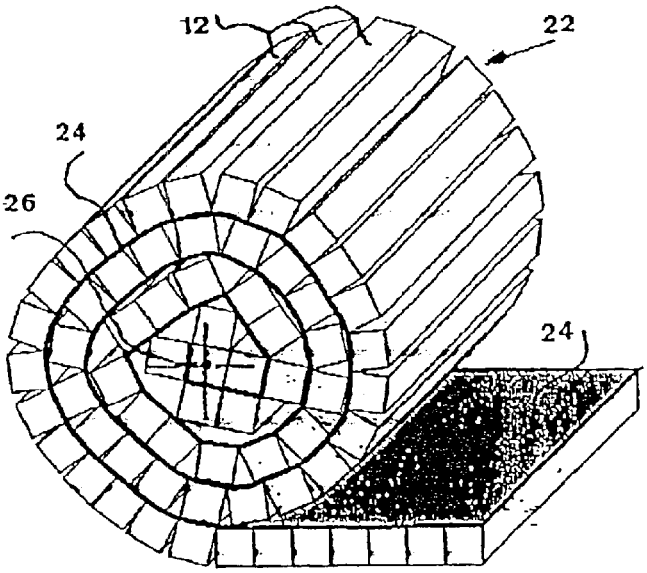
FIG. 2 is a perspective view of a structure that has been rolled up.

Referring now to FIG. 2, there is seen a structure 22 after use which has been rolled into a compact cylindrical package for purposes of transport and storage. Tis possible when the thin sheet 24 faces the center of curvature 26. When the assembly is deployed to form a curved structure, as seen for example in FIG. 4*a*, the beams 12 face inwards towards the center of curvature 26.

With reference to the rest of the figures, similar reference numerals have been used to identify similar parts.

Figure 3:
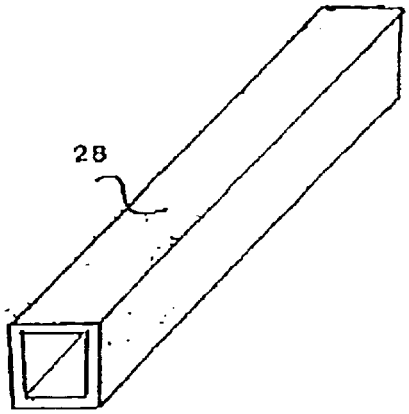
FIG. 3 is a perspective view of a hollow beam, which can be used in the structure.

FIG. 3 illustrates a beam 28 which can be used in an articulated collapsible planar structure, wherein the trapezoidal cross-section is hollow. Suitably the beam is made of an age-hardened aluminium alloy extrusion. Typical wall thickness is about 2 mm.

Where the beam 28 is a plastic extrusion, a wall thickness of about 4–6 mm, depending on size, is used to prevent collapse under compression forces from adjacent beams 28 when the structure is deployed.

Depending on the type of plastics used, beam-to-sheet joining is effected by vibration welding, spot welding, ultrasonic welding, or swaging and staking. Cocuring, a type of fusion bonding, is used for joining beams to the sheet if the beams are made of composites of thermosets.

Seen in FIGS. 4*a*, 4*b*, 4*c*, 4*d* is an articulated collapsible planar structure 30 of the same type seen in FIG. 1, and sized to serve as a substantially semi-circular-section temporary building 32, seen in FIG. 4*a*. Although the windows 34 could be cut on site, it is preferable to cut windows 34 at the factory during manufacture. In FIG. 4*b*, at the start of construction, it is seen that the flexible sheet 36 to which the beams 38 are attached has an extension 40 which serves as the floor of the temporary building 32. Erection takes less time that the erection of a tent, and protection from heat and cold is superior thereto. FIGS. 4*c* and 4*d* show further stages in erection of the building 32. End walls 48 in the present embodiment are made of tarpaulin.

Referring now to FIG. 5, there is depicted an articulated collapsible planar structure 42 being sized to serve, in combination with support legs 44, as a bed. The beams 46 in the present embodiment are made of a rigid foamed plastic such as polyester or polystyrene. Beam shape is practically rectangular, or the shorter face 47 of the trapezoid is attached to steel cables 49, located on the lower face of the beams 46, so that the structure 42 is slightly convex when free and becomes flat when under load.

The bed has three pairs of foldable legs 44, and can be rolled up after use and readily transported in a car.

FIG. 6 shows an articulated collapsible planar structure 50, being sized to serve, in combination with a wall support 52, as a retractable cantilever awning. An extension 54 of the thin sheet 56 is bonded to the upper surface of the wall support 52. The concave configuration 58 of the awning near the support 52 is achieved by reversing the trapezoid beam 60 in this section, the narrow face 62 thereof being bonded to the thin sheet 56.

The figure also illustrates the use of different sized beams in a single structure, larger beam sections 63 being used near the wall support 52 where stress is highest. The larger beams are effective in reducing both compressive stress on the beam as well as tensile stress on the sheet 52 and shear stress on the beam-to-sheet attachment.

In the present embodiment the thin sheet 56 is made of a fiber-reinforced plastic, for example a glass-reinforced polyester, the fibers being oriented perpendicularly to the long axis of the beams 12, 60.

After use the awning structure 50 is rolled up and rests on the wall support 52, as seen in FIG. 7.

Seen in FIG. 8 is an articulated collapsible planar structure 64, comprising, as in FIG. 1, a plurality of parallel rigid beams 12 of substantially trapezoidal cross-section rigidly attached in close formation.

In one section 66 of the structure 64 the longer of the two unequal beam faces 14 is attached to the thin sheet 68 of a tensile strong material. However in another section 70 of the structure 64 the shorter of the two unequal faces 72 is attached to the sheet 68. In this manner it is possible to produce either convex or concave forms. Further examples of such structures are seen in FIGS. 6 and 9.

The structure 64 is rollable into a package after use.

Referring now to FIG. 9, there is depicted an articulated collapsible planar structure as of the type described with reference to FIG. 8, being sized to serve as a seat 74. The seat 74 is particularly useful for use at a beach, as the large base area 76 provides stability on sand. After use the chair may be rolled up and then easily fits into the luggage compartment of any car.

Referring now to FIG. 10 there is depicted an embodiment where the rigid beams 12 are provided with hinges 13 which enable the connection of the beams in close formation to a structure as addressed above with the same properties.

The scope of the described invention is intended to include all embodiments coming within the meaning of the following claims. The foregoing examples illustrate useful forms of the invention, but are not to be considered as limiting its scope, as those skilled in the art will readily be aware that additional variants and modifications of the invention can be formulated without departing from the meaning of the following claims.

I claim:

1. An articulated collapsible structure comprising:

(a) a plurality of beams formed from substantially incompressible material, each of said beams having a length, an elongated face partly bounded by two parallel straight edges, said edges being parallel to said length, and two side surfaces, each of said side surfaces meeting said elongated face at one of said edges; and (b) a stretch-resistant connecting arrangement pivotally interconnecting said beams at said edges of said elongated faces sequentially in side-by-side relation with said lengths parallel, said connecting arrangement allowing pivotal relative movement between adjacent ones of said beams while maintaining adjacent ones of said edges of said adjacent beams in substantially close relation, such that the structure can be transformed between a deployed state in which at least part of said side surfaces of adjacent ones of said beams are in abutment so as to form a self-supporting structure, and a rolled state in which said side surfaces are separated and the structure assumes a generally cylindrical rolled state, wherein said side surfaces of each of a plurality of said beams are non-parallel such that said self-supporting structure has an at least partially curved profile.

2. The articulated collapsible structure of claim 1, wherein said connecting arrangement includes flexible sheet material attached to at least part of said elongated faces of said beams.

3. The articulated collapsible structure of claim 1, wherein said connecting arrangement includes a plurality of hinges.

4. The articulated collapsible structure of claim 1, wherein said beams are hollow beams.

5. The articulated collapsible structure of claim 1, wherein said self-supporting structure is adapted to form at least part of a building.

6. The articulated collapsible structure of claim 1, wherein said self-supporting structure is adapted to form at least part of an article of furniture.

7. The articulated collapsible structure of claim 1, wherein said self-supporting structure is adapted to form at least part of a cantilevered awning.

8. An articulated collapsible structure deployable in a self-supporting cantilevered state relative to a wall, the articulated collapsible structure comprising:

(a) a plurality of beams formed from substantially incompressible material, each of said beams having a length, an elongated face partly bounded by two parallel straight edges, said edges being parallel to said length, and two side surfaces, each of said side surfaces meeting said elongated face at one of said edges;

(b) a stretch-resistant connecting arrangement pivotally interconnecting said beams sequentially in side-by-side relation with said lengths parallel, said connecting arrangement allowing pivotal relative movement between adjacent ones of said beams while maintaining adjacent ones of said edges of said adjacent beams in substantially close relation, such that the structure can be transformed between a deployed state in which at least part of said side surfaces of adjacent ones of said beams are in abutment so as to form a self-supporting structure, and a rolled state in which said side surfaces are separated and the structure assumes a generally cylindrical rolled states; and (c) a wall support element adapted to be secured to a wall, said wall support element being pivotally interconnected with one of said beams such that;

said deployed state is a self-supporting cantilevered state projecting from the wall.

9. The articulated collapsible structure of claim 8; wherein said connecting arrangement includes flexible sheet material attached to at least part of said elongated faces of said beams.

10. The articulated collapsible structure of claim 8, wherein said connecting arrangement includes a plurality of hinges.

11. The articulated collapsible structure of claim 8, wherein said beams are hollow beams.

12. An articulated collapsible structure comprising:

(a) a plurality of beams formed from substantially incompressible material, each of said beams having a length, an elongated face partly bounded by two parallel straight edges, said edges being parallel to said length, and two side surfaces, each of said side surfaces meeting said elongated face at one of said edges;

(b) a stretch-resistant connecting arrangement pivotally interconnecting said beams sequentially in side-by-side relation with said lengths parallel, said connecting arrangement allowing pivotal relative movement between adjacent ones of said beams while maintaining adjacent ones of said edges of said adjacent beams in substantially close relation, such that the structure can be transformed between a deployed state in which at least part of said side surfaces of adjacent ones of said beams are in abutment so as to form a substantially-flat, self-supporting structure, and a rolled state in which said side surfaces are separated and the structure assumes a generally cylindrical rolled state; and (c) at least one leg associated with each of at least two of said beams, each of said legs being deployable between a folded state in which said leg lies substantially flat against said beam for said rolled state and an open state in which said leg projects downwards from said beam so as to support said beams above an underlying surface such that said substantially-flat structure provides a load-bearing flat surface.

13. The articulated collapsible structure of claim 12, wherein said connecting arrangement includes flexible sheet material attached to at least part of said elongated faces of said beams.

14. The articulated collapsible structure of claim 12, wherein said connecting arrangement includes a plurality of hinges.

15. The articulated collapsible structure of claim 12, wherein said beams are hollow beams.

* * * * *